United States Patent [19]

Bell

[11] Patent Number: 4,956,026

[45] Date of Patent: Sep. 11, 1990

[54] COATED ARTICLE HAVING A BASE OF AGE-HARDENED METAL

[75] Inventor: James A. E. Bell, Oakville, Canada

[73] Assignee: Inco Limited, Toronto, Canada

[21] Appl. No.: 348,941

[22] Filed: May 8, 1989

Related U.S. Application Data

[62] Division of Ser. No. 169,283, Mar. 27, 1985.

[30] Foreign Application Priority Data

Jul. 4, 1987 [CA] Canada ..... 534009

[51] Int. Cl.[5] ..... C22F 1/08; C22F 1/10; C22F 1/14; C21D 9/00

[52] U.S. Cl. ..... 148/127; 427/383.9

[58] Field of Search ..... 428/610, 672, 670, 669, 428/671; 148/11.5 Q, 127; 427/383.9

[56] References Cited

U.S. PATENT DOCUMENTS

| | | | |
|---|---|---|---|
| 2,608,753 | 9/1952 | Mooradian | 29/199 |
| 3,134,701 | 5/1964 | Evans et al. | 148/11.5 Q |
| 3,157,539 | 11/1964 | Dreher | 148/127 |
| 3,607,150 | 4/1971 | McGinn | 29/199 |
| 3,622,285 | 11/1971 | Hayes | 29/199 |
| 4,465,742 | 8/1984 | Nagashima et al. | 428/621 |
| 4,480,014 | 10/1984 | Milligan et al. | 428/672 |
| 4,521,257 | 6/1985 | Gevetter et al. | 148/11.5 Q |
| 4,551,184 | 11/1985 | Bell et al. | 148/127 |

FOREIGN PATENT DOCUMENTS

| | | | |
|---|---|---|---|
| 58-578 | 8/1982 | European Pat. Off. . | |
| 087132 | 1/1983 | European Pat. Off. . | |
| 129391 | 12/1984 | European Pat. Off. . | |
| 55-94730 | 7/1980 | Japan . | |
| 60-127673 | 7/1985 | Japan | 428/680 |
| 60-238464 | 11/1985 | Japan | 428/671 |
| 719803 | 12/1954 | United Kingdom | 428/672 |
| 934559 | 8/1963 | United Kingdom | 428/610 |
| 1008014 | 10/1965 | United Kingdom . | |
| 1124684 | 8/1968 | United Kingdom . | |

OTHER PUBLICATIONS

Russell, R. J., "Properties of Inlay Clad Wrought Gold Alloys", Solid State Technology, Aug. 1976, pp. 34–48.

*Primary Examiner*—John J. Zimmerman
*Attorney, Agent, or Firm*—Francis J. Mulligan, Jr.; Edward A. Steen

[57] ABSTRACT

A structure comprising a base of an age-hardened alloy having on at least part of the surface thereof a layer of precious metal. The precious metal, e.g. gold, contains amounts of nickel grading downwardly from the inner surface of the precious metal layer such that the outer surface contains about 1% to about 10% nickel. The process of making such a structure is also disclosed.

12 Claims, No Drawings

COATED ARTICLE HAVING A BASE OF AGE-HARDENED METAL

This is a division of co-pending application Ser. No. 169,283 filed on Mar. 17, 1988.

The present invention is concerned with articles, parts or structures made of an age-hardened metal and having on the surface thereof a coating of wear-resistant precious metal, e.g. gold, platinum or palladium, and more particularly with a process for making same.

BACKGROUND AND PROBLEM

The present invention is an improvement with respect to a process and product disclosed by Manfrid Dreher in U.K. Specification No. 934,559 published Aug. 21, 1963. For convenience this specification will be designated the "Dreher patent". The Dreher patent discloses the problem sought to be solved by applicant and a partial solution thereto. Dreher suggests forming an article from an age-hardenable alloy while that article is in the solution-treated or soft annealed condition. The formed article, otherwise ready for hardening by aging heat treatment is then plated with gold or a gold alloy. The thus formed plated article is then subjected to an aging treatment suitable for the particular substrate alloy employed and ranging in temperature from 325° C. to 600° C. and in time from ½ to 20 hours. By this process, Dreher discloses that he produces components which have excellent mechanical properties and maximum protection against corrosion.

Applicant has exactly the same purposes in mind as did Dreher but, in addition, applicant desires to produce a finished article, component or the like in which the surface precious metal is controllably alloyed so that enhanced wear resistance can be achieved without significantly, detrimentally affecting the character of the precious metal on the object surface. The difficulty with the process of the Dreher patent is that while inherently Dreher must have conceived of the interdiffusion of elements from the age-hardening substrate alloy and the overlayer of gold or other precious metal, no control steps or features are disclosed by Dreher to enable a worker in the art to reliably produce a surfaced article wherein the precious metal surface has reproducible hardness or wear-resistance characteristics as well as corrosion resistance, electrical properties and other features characteristic of a precious metal.

OBJECT OF THE INVENTION

It is an object of the present invention to improve upon the process and product disclosed in the Dreher patent as well as to expand upon and broaden the scope of the art in which an article having a substrate of an age-hardened alloy is provided with a precious metal surface having controlled characteristics.

GENERAL STATEMENT OF THE INVENTION

The present invention contemplates a process in which the first step is as described by Dreher, i.e. forming by whatever means required an article, component, etc. (generically termed a structure) from an alloy age-hardenable in the range of about 300° C. to 600° C. for about 0.01 to about 3 hours. The alloy is in the solution annealed (or soft annealed) condition and the structure thus formed is in the soft, unaged condition. The present invention contemplates depositing on this thus provided structure a first or inner layer of nickel or cobalt and a second or outer layer of precious metal from the group consisting of gold, platinum, palladium and alloys rich in these elements. In instances where the age-hardenable alloy contains greater than 90% nickel and/or cobalt, the first or inner layer of nickel or cobalt can be eliminated. The layer of precious metal is of controlled thickness relative to the character of the agehardenable alloy formed into the structure. This correlation is such that after age-hardening of the structure having the outer precious metal deposit, there will be caused by interdiffusion an amount of nickel or cobalt to exist in the precious metal grading downwardly from the inner to the outer surface so that at the outer surface of the precious metal, nickel and/or cobalt is present in the range of about 1% to about 10% by weight effective to harden the precious metal but not essentially change the character thereof. For convenience, the invention will be more fully described in connection with the use of gold as the outer surface of the structure and nickel as the intermediate or base layer upon which gold is deposited.

An intermediate layer of nickel (or cobalt) between a gold outer layer and an underlying non-nickel-rich age-hardenable alloy base forms a barrier to the diffusion of elements in the underlying alloy into the gold. Elements such as iron and copper can form deleterious corrosion products in gold if the barrier is omitted. These corrosion products mar the luster of the composite article and give it an inferior performance if used as an electrical contact.

The present invention also contemplates the structure produced by the process of the present invention which comprises a formed structure having a base of age-hardened metal and a surface of precious metal over at least a portion of the structure, said precious metal varying in nickel and/or cobalt content between the surface closest to the base and the outer surface such that at the outer surface the precious metal contains about 1 to about 10% total nickel and cobalt and the total nickel plus cobalt increases in the inward direction. This structure as defined results of course from interdiffusion of nickel or cobalt with the precious metal during the age-hardening heat treatment, the nickel and/or cobalt being derived either from the age-hardening alloy itself or from an intermediate nickel or cobalt deposit.

MORE PARTICULAR DESCRIPTION OF THE INVENTION

Some copper-base age-hardenable alloys disclosed by Dreher which are useful in practicing the present invention and which can be formed in solution treated or soft annealed condition to provide a structure are set forth in Table I.

TABLE I

| Substrate Alloy | | | | | Hardening | Hardening Time |
|---|---|---|---|---|---|---|
| % Cu | % Be | % Si | % Mn | % Ni | Range °C. | Hrs. |
| 98–98.3 | 1.7–2.0 | | | | 325 | 1–4 |
| 95 | | 5 | — | | 500 | 8–20 |
| 94 | | 6 | — | | 600 | 4–16 |
| 94.8–93.3 | | 3.5–5 | 1.7 | | 400 | 20 |
| Balance | | 2–5 | 1–2 | | 350–400 | 12 |
| 90 | | 2.75 | 7.65 | | 400 | 1 |
| Balance | | 0.5–0.7 | | 1.7–2.1 | 400–470 | ½–2 |
| Balance | | 0.8–1.0 | | 3.2–4.0 | 400–470 | ½–2 |

Additional copper-beryllium age-hardening alloys useful for structures of the present invention are set forth in Table II.

TABLE II

| Alloy | Aging Temp., °C. | Aging Time, Hr. |
|---|---|---|
| 98.5–99.3 Cu, 0.1–0.15 Be, 0.6–1.0 Cr | 454–510 | 2 to 3 |
| 98–98.5 Cu, 0.25–0.50 Be, 1.4–1.6 Ni | 443–455 | 2 |
| 96.5–97.5 Cu, 0.25–0.50 Be, 1.4–1.7 Co, 0.9–1.1 Ag | 449–499 | 2 |
| 96.2–97.2 Cu, 0.4–0.7 Be, 2.35–2.70 Co | 454–482 | 2 to 3 |
| 95–98 Cu, 1–1.2 Be, 0.4–0.8 Sn, 1.5–2.25 Zn | 344 | 4 to 5 |
| 97.5–98.2 Cu, 1.6–1.8 Be, 0.2–0.6 Ni + Co | 302–344 | 2 to 3 |
| 97–98 Cu, 1.8–2.05 Be, 0.2–0.6 Ni + Co | 302–344 | 2 to 3 |
| 97–98 Cu, 2–2.5 Be, 0.35–0.65 Co | 344 | 3 |
| 96.5–97 Cu, 2.6–2.85 Be, 0.35–0.65 Co | 344 | 3 |

Another type of copper-base age-hardenable alloy hardened by the mechanism of spinodal decomposition and useful in the practice of the present contains about 4 to 15% tin, 3.5 to 50% nickel, lance essentially copper. Such alloys can be age-hardened in the range of about 300° C. to about 450° C. Other useful age-hardenable copper-base alloys are described in U.S. Patent No. 4,016,010 (Cu/Ni/Al) and in U.S. Pat. No. 4,606,889 (Cu/Ti/Be). As an example, U.S. Pat. No. 4,016,010 discloses that copper-base alloys containing 10–30% nickel and 1–5% aluminum can be age-hardened in the range of 250–650° C. for times ranging from ½ hour to 24 hours. Those skilled in the art will appreciate that generally with agehardenable alloys shorter times are used with higher temperatures and vice versa. Some age-hardenable nickel alloys can also be useful in the present invention especially if they are only partially age-hardened in the lower ranges of age-hardening temperature. Nominal compositions of several such nickel-base alloys are set forth in TABLE III.

TABLE III

| Ni | Cu | Cr | Al | Ti | Fe | Aging Temp., °C. | Aging Time, Hrs. |
|---|---|---|---|---|---|---|---|
| 96.5 | — | — | 4.4 | 0.6 | 0.3 | 483–593 | 2–24 |
| 66.5 | 29.5 | — | 2.7 | 0.6 | 1.0 | 483–593 | 2–24 |
| 79.5 | — | 15.5 | 3.2 | 0.6 | 1.0 | 590–760 | 2–24 |

Another type of substrate material useful in the present invention is maraging steel represented by a composition containing less than 0.03% carbon, about 18.5% nickel, about 7% cobalt, about 4.5% molybdenum, about 0.2% titanium, about 0.003% boron, balance iron. This type of material is softened by an anneal at about 815° C. or higher and air cooling. After an object is formed, the maraging steel is then hardened by heating to about 480° C. for about three hours. Compositions in weight percent of other iron-base alloys which are amenable to age-hardening at temperatures in the range of about 455° C. to about 595° C. after being formed in the austenitic or solution annealed condition are set forth in TABLE IV.

TABLE IV

| Alloy | Stainless W | 17-4 PH | 17-7 PH | PH 15-7 Mo |
|---|---|---|---|---|
| Ni | 7 | 4 | 7.1 | 7 |
| Cr | 17 | 16.5 | 17 | 15 |
| Mn | 1 max | 1 max | 1 max | 1 max |
| Si | 1 max | 1 max | 1 max | 1 max |
| C | 0.08 max | 0.07 max | 0.09 max | 0.09 max |
| Al | 0.4 | — | 1 | 1 |

TABLE IV-continued

| Alloy | Stainless W | 17-4 PH | 17-7 PH | PH 15-7 Mo |
|---|---|---|---|---|
| Ti | 1.2 | — | — | — |
| Cu | — | 4 | — | — |
| Nb + Ta | — | 0.3 | — | — |
| Mo | — | — | — | 2.5 |
| Fe | Bal. | Bal. | Bal. | Bal. |

The substrate material whether copper-base, nickel-base or iron-base is formed in any conventional (or unconventional) manner to the shape of the desired structure. This forming can be by hot and/or cold-working including, but not limited to, forging, extrusion, drawing, spinning, piercing, machining, bending, etc. Likewise surface finishing can be done by any suitable means, e.g. machining, brushing, polishing, grit blasting, buffing or the like. It is important however that the structure provided in accordance with the present invention have a clean surface, free from grit, dust, grease, etc. so that it will accept an adherent deposit of nickel.

Applicant finds advantage in providing a nickel deposit on the structure by electrodeposition. While other means of providing a nickel deposit such as chemical deposition, sputtering, ion bombardment, etc. are within the contemplation of the present invention, electroplating has been found to be an easy, reliable method of providing a nickel deposit which is essentially free from organic residue, sulfur and low melting phases. The nickel electrodeposit, required on all substrates except those containing at least 90% nickel, is accomplished by standard procedures from Watts-type, chloride, fluoborate and sulfamate baths such as those disclosed in Electroplating Engineering Handbook, Graham, Van Nostrand-Reinhold, 3rd Ed., 1971, pages 247 and 248. Suitable cobalt plating baths which may be used in place of nickel plating baths are set forth as baths (a) through (d) on page 190 of Modern Electroplating, A. G. Gray, J. Wiley & Sons, NY, Chapman & Hall Limited, London, 1953. Another way of providing a nickel deposit on an age-hardenable alloy is, at an early stage of working, to laminate the age-hardenable alloy with nickel sheet and thereafter hot work the composite material so as to form a metallurgical bond between the age-hardenable alloy and the nickel. The desired structure is then formed from the bonded, composite material This method of providing a nickel surfaced substrate has the disadvantage that cut or sheared edges will be devoid of nickel. Often, however, such edges are not critical to the utility of a structure.

In most cases, there is no upper limit to the thickness of a nickel coating or deposit on a structure except that limit which may be imposed by practicality, e.g. about 40 micrometers when nickel is electrodeposited. It is important that the nickel on the surface of the structure be at least about 0.3 micrometers thick and advantageously in the range of 1 to 10 micrometers in thickness. As mentioned hereinbefore, the nickel (or cobalt) layer acts as a barrier coating to diffusion of unwanted elements in the base into the gold. When the product composite article with a copper alloy base is used as an electrical contact, the nickel layer should be kept thick enough to prevent atoms from the substrate from migrating to the gold surface while at the same time supplying nickel atoms for diffusion into the gold for hardening. At the same time, the nickel layer should be as thin as can be to serve both of these functions in order to minimize the electrical resistance of the composite structure.

In carrying out the invention it is important that both the gold and nickel deposits are free from deleterious amounts of organic or other matter which could decompose and cause blistering during age-hardening. The gold on the nickel surface of the base is advantageously electrodeposited as pure (24 KT) gold from an electroplating bath using conditions applicable to obtaining a pure electrodeposit. For purposes of this specification and claims, however, gold need not be 100% pure. For purposes of this invention, the term "gold" includes not only pure gold but also yellow alloys and reddish yellow alloys which may contain silver, copper, nickel, a platinum-group metal and combinations thereof. Gold containing up to about 8% to 10% by weight nickel will retain its gold color equivalent to the color of 14 KT to 18 KT gold-silver-copper alloy. If an alloy is plated however, one must consider in the aforementioned 8–10% nickel, that amount of nickel which will, by diffusion, appear on the surface of the gold plated structure after age-hardening.

The gold layer on the nickel surface of the base is advantageously electrodeposited from a cyanide type bath. Such baths are usually of proprietary nature. However, the general types of cyanide baths and conditions of operation are set forth in standard reference sources such as Electroplating Engineering Handbook (3 ed.) ibid at page 242 and in References 1, 2, 29, 30, 31, 32 and 33 listed on page 255 of that work. It is also within the contemplation of the present invention to provide gold layers of the requisite thickness by means other than electroplating provided, of course, that the quality of the adhesion of the gold layer to the nickel is at least equivalent to that provided by electroplating. As those skilled in the art are aware, the quality of adhesion of an electroplate depends to a large extent on the care taken in surface preparation and cleaning of the base to be plated. In this regard Chapter 3 of the aforecited Electroplating Engineering Handbook entitled Metal Surface Preparation and Cleaning is recommended to those desiring to practice the present invention.

A precious metal, advantageously gold, layer is deposited on top of the nickel surface on the formed structure in condition to be age-hardened. The thickness of the precious metal layer depends upon the age-hardening conditions and is generally in the range of about 0.1 or 0.2 to about 2.5 micrometers. This is not to say that thicker precious metal layers cannot be used. However deposits greater than 2.5 micrometers in thickness are generally not economically feasible. According to the invention, the thickness of the precious metal outer layer on the formed structure increases as the combined time-temperature parameter of age-hardening increases. Speaking particularly with respect to gold in specific layer thicknesses of 0.3 and 0.6 micrometers, aging at the combined timetemperature parameters set forth in TABLE V are equivalent one to the other with respect to interdiffusion of gold and nickel.

TABLE V

| Temp., °C. | Time (minutes) (0.3)* | (0.6)* |
|---|---|---|
| 450 | 4 | 15 |
| 400 | 24 | 82 |
| 375 | 50 | 196 |
| 350 | 110 | — |

*Au thickness in micrometers

The combined temperature-time parameters set forth in TABLE V are sufficient to produce a surface containing about 2% nickel in a gold coating of the indicated thickness. It is to be noted that considerable scope exists to match the age hardening properties of the desired base metal with usable gold thicknesses.

While it is preferred in accordance with the present invention to provide the basic age-hardenable structure in fully formed condition and ready to be age-hardened prior to depositing gold thereon, it is within the contemplation of the invention to work the composite structure, i.e. the age-hardenable alloy base, a nickel inner layer and an outer gold layer to final configuration. Thus the composite structure can be cold worked by forging, drawing, swaging, coining and the like before age-hardening is carried out. One should observe a caution, especially with alloys, e.g. copper-base alloys, hardened by spinodal decomposition that cold work after a solution or softening anneal and quench or rapid cool can alter the kinetics of the spinodal decomposition reaction. Generally this alteration of the kinetics by residual cold work results in a speeding up of the spinodal decomposition at a given temperature and is effective whether the cold work is performed before or after plating.

In carrying the present invention into practice it is advantageous to employ a copper-base precipitation hardenable or spinodal decomposition hardenable alloy amenable to heat treatment in the range of about 325° C. to 500° C. Examples are now given.

EXAMPLE I

A preform of copper 1.9% Be-1.0% Co alloy is solution treated at about 760° C. for about 2 hours. The preform is then quenched in water and cold worked to the shape of an electrical connector device. The thus worked object is then electroplated with about 2 micrometers of nickel and 0.3 micrometers of gold. Age-hardening is then carried out at 375° C. for about 60 minutes. After cooling it is found that the plated object has the optimum mechanical characteristics of the age-hardened copper-beryllium alloy and a gold, wear-resistant surface containing about 3% nickel.

EXAMPLE II

The same procedure as in EXAMPLE I was carried out using a preform of copper 0.5 Be-2.5% Co alloy except that solution treatment was carried out at about 925° C. 0.6 micrometers of gold was plated and age-hardening was carried out for 2 hours at 400° C. Again, the base is in optimally age-hardened condition and the gold surface contains about 4% nickel to impart significant wear resistant characteristics.

EXAMPLE III

An object preform made of copper-9% Ni—6% Sn alloy is hot worked, solution annealed at about 800° C., quenched and cold worked. About 3 micrometers of nickel is plated on the thus produced structure and 0.6 micrometers of gold is deposited over the nickel. After age-hardening at 400° C. for 2 hours, the structure has a base of fully hardened alloy and a wear-resistant surface of gold containing about 4% nickel.

Many other precipitation hardening or spinodal decomposition hardening alloys of copper exist including Cu-Ni-AI and Cu-Ti-Be alloys. These alloys are 11 solution annealed at about 800° to 950° C., water quenched, and age hardened from 300° to 500° C. from a few minutes to 24 hours. In all case, the alloys can be plated with from 1 to 10 micrometers of Ni and a thickness of Au selected from 0.1 to 2.5 micrometers such that when the material is age hardened the correct surface composition of Ni in the gold surface of greater than about 1% and less than 10% is achieved.

EXAMPLE IV

An object preform made of an essentially carbon-free maraging steel containing 18.5% nickel, about 7% cobalt, about 4.5% molybdenum, about 0.2% titanium, about 0.003% boron, balance iron is solution annealed at about 900° C. after hot and cold working and then air cooled to room temperature. The thus formed structure is electroplated with about 6 micrometers nickel and 1.5 micrometers gold. After age-hardening at 480° C. for about 2 hours, the maraging steel is in the hardened condition and the gold contains an effective amount of nickel at its surface to resist wear.

EXAMPLE V

An object preform made of age-hardenable nickel containing principally 4.4% aluminum and 0.6% titanium is electroplated with gold to a thickness of about 2 micrometers. Upon age-hardening at about 500° C. for 3 hours, the base nickel increased substantially in hardness compared to unaged material and the gold contains at its surface an amount of nickel effective to increase wear resistance.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed as defined as follows.

1. A process for producing an age-hardened article having on the surface thereof a layer of precious metal from the group consisting of gold and platinum group metals comprising:

(a) providing in a condition to be age-hardened a nickel and/or cobalt surfaced structure having a base of an alloy age-hardenable in the range of 300° to about 600° C.;

(b) depositing on at least part of the surface of said structure a layer of said precious metal correlated in thickness to the time and temperature of age-hardening such that after age-hardening said precious metal will have a surface nickel plus cobalt content of about 1% to about 10% by weight effective to increase the wear-resistance of said layer of precious metal; and (c) thereafter age-hardening said structure having said base and said precious: metal layer to thereby effect:

(1) interdiffusion of said precious metal and said nickel to enhance both the adhesion of said precious metal layer to said base and enhanced wear-resistance of said precious metal without destruction of the inherent qualities of said precious metal; and (2) hardening of said base alloy.

2. A process as in claim 1 wherein said precious metal is gold.

3. A process as in claim 2 wherein said gold is in a layer about 0.1 to about 2.5 micrometers thick.

4. A process as in claim 1 wherein said nickel and/or cobalt surface on said article is an electrodeposit.

5. A process as in claim 1 wherein the nickel and/or cobalt surface on said structure is about 1 to about 10 micrometers in thickness.

6. A process as in claim 1 wherein said age-hardenable alloy is a copper-base alloy.

7. A process as in claim 1 wherein said age-hardenable alloy is an iron-base alloy.

8. A process as in claim 1 wherein said age-hardenable alloy is a nickel-base alloy.

9. A process as in claim 6 wherein said copper-base alloy is age-hardenable in the temperature range of 300° to about 600° C. for about 0.1 to about 3 hours.

10. A process as in claim 9 wherein said age-hardenable copper-base alloy is selected from the group of precipitation hardenable copper-base alloys and copper-base alloys hardenable by the mechanism of spinodal decomposition.

11. A process as in claim 10 wherein said age-hardenable copper-base alloy is a copper-beryllium alloy.

12. A process as in claim 10 wherein said age-hardenable copper-base alloy is a copper-nickel-tin alloy hardenable by the mechanism of spinodal decomposition.

* * * * *